US005194362A

United States Patent [19]

Nakabayashi et al.

[11] Patent Number: 5,194,362

[45] Date of Patent: Mar. 16, 1993

[54] SUBBED PAPER SUPPORT FOR HEAT DEVELOPMENT DYE DIFFUSION TRANSFER

[75] Inventors: Keiko Nakabayashi, Hino; Keiji Ohbayashi, Hachioji; Masaru Tsuchiya, Hidaka, all of Japan

[73] Assignee: Konica Corporation, Tokyo, Japan

[21] Appl. No.: 814,445

[22] Filed: Dec. 30, 1991

[30] Foreign Application Priority Data

Jan. 17, 1991 [JP] Japan ..... 3-3840

[51] Int. Cl.[5] ..... G03C 5/54; G03C 1/87

[52] U.S. Cl. ..... 430/203; 430/212; 430/536; 430/538

[58] Field of Search ..... 430/203, 212, 536, 538

[56] References Cited

U.S. PATENT DOCUMENTS

| | | | |
|---|---|---|---|
| 4,916,043 | 4/1990 | Nagumo et al. | 430/203 |
| 5,001,033 | 3/1991 | Takeno et al. | 430/203 |
| 5,051,335 | 9/1991 | Kato | 430/203 |
| 5,089,370 | 2/1992 | Tamagawa et al. | 430/203 |

*Primary Examiner*—Richard L. Schilling
*Attorney, Agent, or Firm*—Finnegan, Henderson, Farabow, Garrett and Dunner

[57] ABSTRACT

An image forming method using a heat developable light-sensitive material is disclosed. The light-sensitive material is lowered in curling caused by humidity changing at room temperature or heating at development. The method comprises the following steps of imagewise exposing to light a heat developable light-sensitive material comprising a paper support having thereon a subbing layer comprising a hydrophobic resin and a light-sensitive layer being provided on the subbing layer, in which the light-sensitive layer comprises a hydrophilic binder, light-sensitive silver halide grains and a dye providing substance, developing the light-sensitive material be heating, contacting the light-sensitive material with a dye-receiving material, and transferring a diffusible dye formed in the light-sensitive material to the dye-receiving material in the presence of a solvent. The hydrophobic resin of the subbing layer has a glass transition point of from 30° C. to 250° C.

The above object of the invention is accomplished by an image forming method comprising the following steps of imagewise exposing to light a heat developable light-sensitive material comprising a paper support having thereon a subbing layer comprising a hydrophobic resin having a glass transition point of from 30° C. to 250° C. and a light-sensitive layer being provided on the subbing layer, in which the light-sensitive layer comprises a hydrophilic binder, light-sensitive silver halide grains and a dye providing substance, developing the light-sensitive material by heating, contacting the light-sensitive material with a dye-receiving material, and transferring a diffusible dye formed in the ligh -sensitive material in the developing step to the dye-receiving material in the presence of a solvent capable of dissolving the diffusible dye.

11 Claims, No Drawings

SUBBED PAPER SUPPORT FOR HEAT DEVELOPMENT DYE DIFFUSION TRANSFER

FIELD OF THE INVENTION

The present invention relates to a method for forming an image with use of a heat-development-type silver halide photographic light-sensitive material, and more particularly to an image forming method which uses a heat-developable light-sensitive material that is improved so as to hardly curl against changes in the humidity at room temperature or when heated for forming a dye image.

BACKGROUND OF THE INVENTION

The heat development, which needs only heating for the formation of an image, is already known. There are known heat-developing processes for black-and-white image formation and color image formation, and also well-known transfer-type heat-developable light-sensitive materials in which the heat-developed image is transferred onto an image-receiving layer.

Conventionally known as the support for the heat-developable light-sensitive material include various materials such as paper, synthetic paper, laminated paper, plastic film, and the like, which are selectively used according to purposes. The particularly preferred among these support materials is polyethylene terephthalate film (PET). This is commonly used from the economical and ease-of-handling point of view. The use of PET as the support for the heat-developable light-sensitive material, however, is disadvantageous because PET film softens as its temperature rises, and tends to thermally shrink at a heat-developing temperature (normally 80° to 200° C.), so that it sometimes causes jamming or creasing trouble.

In contrast, paper is advantageous in that it neither softens nor shrinks at a high temperature, and for cost reduction as well.

However, where paper is used as the support for the heat-developable light-sensitive material, it is liable to curl under low or high humidity conditions; the phenomenon becomes conspicuous particularly at the time of heat development.

The curl, in the diffusion transfer of a dye image from the light-sensitive material onto an image-receiving material, causes the transferred image to have uneven densities as well as jamming trouble to occur inside the processing device. In order to prevent such troubles attributable to the curl at the time of the heat-development, JP O.P.I. No. 205935/1986 discloses a technique to provide a hydrophilic colloid layer on the reverse side of the light-sensitive material. However, the hydrophilic colloid on the reverse side, because of its hygroscopicity, may cause the heat-developable light-sensitive material to allow transfer of its effective constituent to the reverse side during its storage or to have sticking trouble in a high humidity condition, and is by no means sufficient for improving the light-sensitive material's curl characteristic in heat development while keeping its curl characteristic stable against changes in the humidity at room temperature.

Where a paper support is used for the heat-developable light-sensitive material, if a light-sensitive layer is coated directly on the support, some of the constituents of the light-sensitive layer permeate into the support to thereby cause the formation of a mottled image. In order to prevent the permeation of light-sensitive constituents into the paper support, JP O.P.I. No. 38934/1988 discloses a technique to provide a hydrophobic polymer layer on the paper support. This technique surely solves the above permeation problem, but the use of the technique alone is not sufficient for improving the aforementioned curl problem in heat development.

SUMMARY OF THE INVENTION

It is an object of the present invention to provide a heat-developable light-sensitive material which is improved so as not to curl against changes in the humidity at room temperature or when heated for forming a dye image, and a method for the image formation with use of the heat-developable light-sensitive material.

The above object of the invention is accomplished by an image forming method comprising the following steps of imagewise exposing to light a heat-developable light-sensitive material comprising a paper support having thereon a subbing layer comprising a hydrophobic resin having a glass transition point of from 30° C. to 250° C. and a light-sensitive layer being provided on the subbing layer, in which the light-sensitive layer comprises a hydrophilic binder, light-sensitive silver halide grains and a dye-providing substance.

developing the light-sensitive material by heating, contacting the light-sensitive material with a dye-receiving material, and transferring a diffusible dye formed in the light-sensitive material in the developing step to the dye-receiving material in the presence of a solvent capable of dissolving the diffusible dye.

If the above hydrophobic resin has a Tg of preferably 40° C. to 200° C., and more preferably 50° C. to 200° C., the effect of the invention is further increased.

In the above image forming method, the effect of the invention becomes specially conspicuous when the resin content of the subbing layer comprising the hydrophobic resin is 0.1 to 10 g/m$^2$, the paper support is 100 to 200 μm in thickness, and the binder of the heat-developable light-sensitive material has a coating weight of not more than 8 g/m$^2$.

A preferred embodiment of the invention is an image forming method using a heat-developable light-sensitive material comprising a hydrophobic resin subbing layer-coated paper support having thereon a light-sensitive layer comprising a hydrophilic binder, a light-sensitive silver halide and a dyeproviding material, in which the coating liquid for the subbing layer has a viscosity of not less than 2 centipoises at 23° C.

DETAILED DESCRIPTION OF THE INVENTION

Raw paper used as the paper support of the light-sensitive material of the invention is manufactured from wood pulp, to which are added, as needed, a sizing agent, paper strength increasing agent, flexibilizer, fluorescent dye and the like.

The paper support is preferably 100 to 200 μm in thickness.

The hydrophobic resin for the subbing layer of the invention has a Tg of not less than 30° C., preferably not less than 40° C., and more preferably not less than 50° C.

Examples of the hydrophobic resin of the invention include vinyl acetate resins, ethylene-vinyl acetate resins, styrene-butadiene resins, acryl resins, vinyl acetate-acrylate resins, cyanoacrylate resins, vinyl chloride resins, vinylidene chloride resins, polyvinyl alcohol resins, polyvinyl acetal resins, polyamide resins, polyolefin resins, cellulose resins, polyester resins, polyerethane resins, urea resins, melamine resins, phenol resins, epoxy resins, xylene resins, silicone resins, nitrile resins and copolymers of these resins.

The using amount of the hydrophobic resin in the subbing layer is preferably 0.1 to 10 g/m$^2$.

For coating the hydrophobic resin subbing layer of the invention, there may be used either a coating liquid prepared by dissolving the resin in an organic solvent or an aqueous coating liquid containing the resin in the form of latex particles.

The hydrophobic resin coating liquid for coating the subbing layer has a viscosity of preferably 2 or more centipoises at 23° C.

In order to maintain the above viscosity range of the coating liquid, the hydrophobic subbing layer coating liquid needs to contain solid matter in an amount of 2 to 50% by weight, preferably 5 to 30% by weight, and at the same time to have a surface tension of 20 to 50 dyn/cm, and preferably 25 to 45 dyn/cm.

The subbing layer may contain a hardener, examples of which include acid anhydride hardeners, mineral acids or acid hardeners, peroxide hardeners, multifunctional vinyl hardeners, aldehyde hardeners, metallic salt hardeners, silane hardeners, azilidine hardeners, isocyanate hardeners, ethyleneimine hardeners, polyamine hardeners, epoxy hardeners, melamine hardeners and urea hardeners.

The preferred among these hardeners are the ethyleneimine, isocyanata, epoxy and methanesulfone hardeners such as those described in U.S. Pat. Nos. 2,726,162, 2,816,125, 2,964,404, 2,983,611, 3,103,437, 3,220,848, 3,271,175 and 3,392,024; German Patent Nos. 1,081,169 and 1,085,663: British Patent No. 918,950; JP O.P.I. No. 257564/1964; the 'Plastic Zairyo Koza (The Course of Plastic Materials)' vol. 1 'Epoxy Resins' and vol. 2 'Polyurethane Resins', published by Nikkan Kogyo Shimbun, and the 'Setchaku-Nenchaku no Jiten (Handbook of adhesives)' published by Asakura Shoten; especially, ethyleneimine hardeners, isocyanate hardeners and epoxy hardeners.

In the invention, these hardeners may be used in an amount of preferably 0.1 to 100% by weight, and more preferably 0.5 to 50% by weight of the hydrophobic resin of the subbing layer.

The subbing layer, after being coated, is dried at a temperature of 40° to 170° C., particularly 60° to The hydrophilic binder used for the light-sensitive layer of the invention includes gelatin derivatives such as polyvinyl alcohol, polyvinyl pyrrolidone, gelatin and gelatin derivatives such as phthalated gelatin: and natural high-polymer materials such as proteins and starch, which may be used alone or in combination: particularly the combined use of gelatin or a gelatin derivative with a hydrophilic polymer such as polyvinylpyrrolidone or polyvinylalcohol, and more preferably a gelatino-polyvinylpyrrolidone mixed binder.

The total amount of the hydrophilic binder contained in the layers provided on the light-sensitive layer-coated side of the light-sensitive material is preferably 1 g/m$^2$ to 8 g/m$^2$, and more preferably 1 g/m$^2$ to 6 g/m$^2$.

The heat-developable light-sensitive material of the invention has on its support at least one light-sensitive layer comprising a hydrophilic binder, a light-sensitive silver halide emulsion and a dye-providing material which releases a diffusible dye at the time of heat development, and besides, if necessary, a reducing agent or reducing agent precursor and an organic silver salt.

In the invention, a solvent capable of dissolving the diffusible dye is used at the time of heat development or when the diffusible dye is diffusibly transferred to a dye-receiving layer. As the solvent usable in the invention there may be used water and various other heat solvents. The presence of the above solvent enables not only improving the curl characteristic at a high temperature but also acceleration of the development and dye transfer. Where water is used as the solvent, water is preferably coated on the surface of the heat-developable light-sensitive material immediately before its development or dye transfer. Where a heat solvent is used as the solvent, the heat solvent is a compound for accelerating the proceeding of heat development or dye transfer at the time of the process thereof, and therefore it is preferably in a solid state at room temperature.

Useful compounds as the heat solvent according to the invention are those described in U.S. Pat. Nos. 3,347,675, 3,667,959, 3,438,776 and 3,666,477; Research Disclosure(RD) 17643; JP O.P.I. Nos. 19325/1976, 24829/1978, 60223/1978, 118640/1983, 198038/1983, 229556/1984, 68730/1984, 84236/1984, 191251/1985, 232547/1985, 14241/1985, 52643/1986, 78554/1987, 42153/1987, 44737/1987, 53548/1988, 161446/1988, 224751/1989 and 863/1990.

Examples of the preferable heat solvent are amide derivatives such as stearyl amide, benzamide, p-toluamide, p-acetoxybenzamide and p-butanoyloxy-ethoxybenzamide, and sulfonamide derivatives such as p-toluenesulfonamide.

To be concrete, the useful for the invention are urea derivatives such as dimethyl urea, diethyl urea and phenyl urea; amide derivatives such as acetamide, stearylamide, benzamide. p-toluamide, p-acetoxyethoxybenzamide and p-butanoyloxyethoxy; polyhydric alcohols such as 1,6-hexanediol, pentaerythritol and polyethylene glycol.

The particularly preferred among the above compounds are water-insoluble solid heat solvents, examples of which include those described in JP O.P.I. Nos. 136645/1987, 139545/1987, 53548/1988, 161446/1988, 224751/1989, 863/1990, 120739/1990 and 123354/1990.

The above heat solvent may be incorporated into any arbitrary layers such as the light-sensitive silver halide emulsion layer, intermediate layer, protective layer, dye-receiving layer of an image-receiving member, and added in an amount of preferably 10% to 500% by weight, and more preferably 30% to 300% by weight of the binder contained in the light-sensitive layer or image-receiving layer to which the heat solvent to be added.

Usable compounds as the dye-providing material in the heat-developable light-sensitive material of the invention are the diffusible dye-forming couplers described in JP O.P.I. Nos. 44737/1987, 129852/1987, 169158/1987 and 73949/1991; the leuco dyes described in JP O.P.I. No. 88254/1986; and the azo dyes for use in the heat-development dye-bleach method described in U.S. Pat. No. 4,235,957; preferably dye donators capable of forming or releasing diffusible dyes, and more preferably compounds capable of forming diffusible dyes upon the coupling reaction thereof.

The dye-providing material capable of forming or releasing the diffusible dye suitably usable in the present invention is described below:

The dye-providing material capable of forming or releasing the diffusible dye may be any compound as long as it can form or release a diffusible dye, responding to or responding counter to the reduction reaction of the light-sensitive silver halide and/or organic silver salt, and includes a negative-type dye-providing material and a positive-type dye-providing material.

As the negative-type dye-providing material there are reductive dye-releasing compounds such as those described in U.S. Pat. Nos. 4,463,079 and 4,439,513; and JP O.P.I. Nos. 60434/1984, 65839/1984, 71046/1984, 87450/1984, 88730/1984, 23837/1984, 124329/1984, 165054/1984 and 165055/1984.

Other examples of the negative-type dye-providing material include coupling dye-forming compounds such as those described in U.S. Pat. No. 4,474,867; and JP O.P.I. Nos. 12431/1984, 48765/1984, 174834/1984. 159159/1984, 231040/1984 and 185630/1989.

As the negative-type dye-providing material there are still other preferred coupling-type dye-forming compounds represented by the following Formula (a):

Cp-(J)-(B) Formula (a)

wherein Cp represents a coupler residue which is capable of forming a diffusible dye upon its coupling reaction with the oxidation product of a reducing agent; J is a bivalent organic group that is linked to the active site of Cp; and B is a ballast group. The ballast group is a group having not less than 8 carbon atoms, preferably not less than 12 carbon atoms, and having a function of making the dye-providing material nondiffusible during heat development due to its polymer chain or its molecular characteristics such as a sulfo group useful for waterless heat development. The most preferred ballasting group is in the form of a polymer chain.

The coupling-type dye-providing material having a polymer chain as the ballasting group is preferably one having the polymer chain derived from a monomer represented by the following Formula (b):

Cp-(J)-$(Y)_I$-(Z)-(L) Formula (b)

wherein Cp and J are as defined in Formula (a); Y is an alkylene group, an arylene group or an aralkylene group: I is an integer of 0 or 1; Z is a bivalent organic group: and L is an ethylenically unsaturated group or a group having an ethylenically unsaturated group.

Examples of the coupling-type dye-forming compounds represented by Formulas (a) and (b) include those described in JP O.P.I. Nos. 124339/1984, 181345/1984, 2950/1985, 57943/1986, 59336/1986 and 200859/1989; and U.S. Pat. Nos. 4,631,251, 4,650,748 and 4,656,124. The particularly preferred among them are the polymer-type dye-providing materials described in U.S. Pat. Nos. 4,656,124, 4,631,251 and 4,650,748.

Examples of the positive-type dye-providing material include those described in JP O.P.I. Nos. 55430/1984, 165054/1984, 154445/1984, 116655/1984, 124327/1984, 152440/1984 and 13546/1989.

These dye-providing materials may be used alone or in combination, and the using amount thereof can vary widely depending on the kind thereof used and the use of the heat-developable light-sensitive material, but is preferably 0.005 to 10 g/m$^2$, and more preferably 0.1 to 5 g/m$^2$ of the light-sensitive material.

The incorporation of the above dye-providing material into the photographic component layers of the heat-developable light-sensitive material may be carried out by a method discretionally selected from among the following methods: a method for emulsifiedly dispersing into a hydrophilic colloid solution a solution of the dye-providing material dissolved in a know high-boiling organic solvent such as dibutyl phthalate, dioctyl phthalate or tricresyl phosphate; a method in which an alkaline aqueous hydrophilic colloid solution of the dye-providing material is neutralized with an acid for dispersion; and a method in which a known mechanical means is used to disperse the dye-providing material in a solid state in an aqueous hydrophilic colloid solution.

As the light-sensitive silver halide used in the heat-developable light-sensitive material of the invention there may be used conventionally known silver halides such as silver chloride, silver bromide, silver iodobromide, silver chlorobromide and silver chloroiodobromide.

The above silver halide grain may be of a composition uniform from the inside through the surface thereof, of the core/shell-type having difference in the composition between the inside and the outside thereof, or of a multiphase structure having a stepwise or continuously varying composition.

The silver halide used in the invention may have either an indefinite crystal habit or a definite crystal habit such as a spherical, octahedral, dodecahedral or tetradecahedral crystal form. The silver halide grain may also be a tabular crystal having two parallel crystal faces, one face larger in the area than the other, with its diameter/thickness ratio being approximately or more, as described in JP O.P.I. Nos. 111933/1983 and 111934/1983, and RD22534.

Further, there may also be used an internal latent image-type silver halide emulsion, the grain surface of which is subjected to no advance fogging, as described in U.S. Pat. Nos. 2,592,250, 3,220,613, 3,271,257, 3,317,322, 3,511,622, 3,531,291, 3,447,927, 3,761,266, 3,703,584, 3,736,140 and 3,761,276; and JP O.P.I. Nos. 8524/1975, 3,8525/1975, 15661/1977 and 127549/1980.

To the light-sensitive silver halide, in its grain forming process may be added metallic ions such as of iridium, gold, rhodium, iron, lead, etc., in the appropriate salt form.

The grain diameter of the above silver halide is preferably about 0.02 to 2 μm, and more preferably about 0.05 to 0.5 μm.

In the invention, in preparing the silver halide, the silver halide-forming constituents may be made present together with an organic silver salt that will be mentioned hereinafter, in which part of the organic silver salt may be converted into part of the silver halide.

The light-sensitive silver halide emulsion may have its grain surface chemically sensitized with known sensitizers such as active gelatin, inorganic sulfur, sodium thiosulfate, thiourea dioxide and sodium chloroaurate.

The chemical sensitization may be carried out in the presence of a nitrogen-containing heterocyclic compound or a mercapto group-containing heterocyclic compound.

Further, the light-sensitive silver halide may be spectrally sensitized to blue, green, red and infrared regions by use of known spectrally sensitizing dyes, which are typified by cyanines, merocyanines, tri- or tetra-nucleus cyanines, holopolar cyanines, styryl dyes, hemicyanines and oxonol dyes. These sensitizing dyes may be used in an amount of 1 μmol to 1 mol, preferably 10 μmol to 0.1 mol per mol of silver halide. The sensitizing dye may be added in any stage of the silver halide emulsion preparation process: i.e., at the time of the grain formation or the removal of water-soluble salt, or before, during or after the chemical sensitization.

The light-sensitive silver halide may be used in the amount range of about 0.01 to 50 g, and preferably 0.1 to 10 g per $m^2$ of the light-sensitive material.

The heat-developable light-sensitive material of the invention may, as needed, use a known organic silver salt for the purpose of increasing its sensitivity or improving its developability.

Examples of the organic silver salt usable in the invention include the silver salts of long-chain aliphatic carboxylic acids and of heterocyclic carboxylic acids, such as silver behenate and silver α-(1-phenyltetrazolthio)-acetate, as described in JP O.P.I. Nos. 4921/1978, 52626/1974, 141222/1977, 36224/1978, 37626/1978, 36224/1978 and 37610/1978; and U.S. Pat. Nos. 3,330,633, 3,794,496 and 4,105,451; the silver salts of imino group-having compounds described in JP E.P. Nos. 26582/1969, 12700/1970, 18416/1970 and 22815/1970: JP O.P.I. Nos. 137321/1977, 118638/1983 and 118639/1983; and U.S. Pat. No. 4,123,274; and the silver acetylene described in JP O.P.I. No. 249044/1986.

The preferred among the above silver salts are the silver salts of imino group-having compounds, particularly the silver salts of benzotriazole and its derivatives, such as silver benzotriazole and silver 5-methylbenzotriazole.

The above organic silver salts may be used alone or in combination. The organic silver salt may be prepared in an aqueous solution of a hydrophilic colloid such as gelatin and, after removing its water-soluble salt, may be used as it is, or alternatively, the organic silver salt is isolated and mechanically pulverized into solid particles to be dispersed for use. The organic silver salt is used in an amount of 0.01 g to 50 g, preferably 0.1 g to 10 g per $m^2$ of the light-sensitive material.

The reducing agent used for the heat-developable light-sensitive material of the invention is one appropriately selected, taking into account the developing mechanism or dye forming or releasing mechanism, from among the conventionally known agents for heat-developable light-sensitive materials. The reducing agents herein include reducing agent precursors that release a reducing agent at the time of heat development.

Compounds usable as the reducing agent in the invention include the p-phenylenediamine and p-aminophenol developing agents, phosphoric acid amidophenol developing agents, sulfonamidoaniline developing agents and hydrazone developing agents, phenols, sulfonamidophenols, polyhydroxybenzenes, naphthols, hydroxybisnaphthyls, methylenebisphenols, ascorbic acids, 1-aryl-3-pyrazolidones, pyrazolones, and the precursors of these reducing agents described in U.S. Pat. Nos. 3,351,286, 3,761,270, 3,764,328, 3,342,599 and 3,719,492; RD Nos. 12146, 15108 15127; ane JP O.P.I. Nos. 27132/1981, 135628/1978 and 79035/1982. The dye-providing material can be used also as the reducing agent.

The particularly preferred reducing agents are the salts and derivatives of N-(p-N.N-dialkylamino)phenylsulfamic acid described in JP O.P.I. Nos. 146133/1981 and 227141/1987.

These reducing agents may be used alone or in combination, and used in an amount of 0.01 to 100 millimoles per $m^2$ of the light-sensitive material.

In addition to the above constituents, to the heat-developable light-sensitive material may, if necessary, be added various additives.

Development accelerators usable in the invention include those described in JP O.P.I. Nos. 177550/1984, 111636/1984, 124333/1984, 72233/1986, 236548/1986 and 152454/1989. Further, the development accelerator-releasing compounds described in JP O.P.I. Nos. 159642/1986, 104645/1989 and 110767/1989, or the metallic ions having an electronegativity of not less than 4 described in JP O.P.I. No. 104645/1989 may also be used.

Antifoggants usable in the invention include the higher fatty acids described in U.S. Pat. No. 3,645,739, the mercuric salts described in JP E.P. No. 11113/1972, the Nhalide compounds described in JP O.P.I. No. 47419/1976, the mercapto compound-releasing compounds described in U.S. Pat. No. 3,700,457, JP O.P.I. Nos. 50725/1976, 69994/1989 and 104271/1989, the arylsulfonic acids described in JP O.P.I. No. 125016/1974, the githium carboxylates described in 47419/1976, the oxidation agents described in British Patent No. 1,455,271 and JP O.P.I. No. 101019/1975, the sulfinic acids and thiosulfonic acids described in JP O.P.I. No. 19825/1978, the thiouracils described in JP O.P.I. No. 3223/1976, the sulfur described in 26019/1976, the disulfides and polysulfides described in JP O.P.I. Nos. 42529/1976, 81124/1976 and 93149/1980, the rosins and diterpenes described in JP O.P.I. No. 5743/1976, the carboxyl or sulfonic acid group-having polymeric acids described in JP O.P.I. No. 104338/1976, the thiazolinethiones described in U.S. Pat. No. 4,138,265, the triazoles described in JP O.P.I. Nos. 51821/1979 and 142331/1980, and U.S. Pat. No. 4,137,079, the thiosulfinic acid esters described in JP O.P.I. No. 140883/1980, the di- or tri-halide compounds described in JP O.P.I. Nos. 46641/1984, 57233/1984 and 57234/1984, the thiol compounds described in JP O.P.I. No. 111636/1984, and the hydroquinone derivatives described in JP O.P.I. Nos. 198540/1985 and 227255/1985. Other useful antifoggants include the hydrophilic group-having antifoggants described in JP O.P.I. No. 78554/1987, the polymeric antifoggants described in JP O.P.I. No. 121452/1987, and the ballast group-having antifoggants described in JP O.P.I. No. 123456/1987. The non-dye forming couplers described in JP O.P.I. No. 161229/1989 may also be suitably used.

Base precursors usable in the invention include compounds to be decarboxylated by heating to release basic compounds such as guanidinetrichloroacetic acid, compounds to be decomposed by intramolecular nucleophilic substitution reaction to release amines, and base precursors capable of releasing a base by the reaction of a sparingly water-soluble basic metallic compound such as zinc hydroxide and a compound such as picolinic acid capable of forming a complex salt by its reaction with the metallic ions constituting the above metallic compound, which are all described in JP O.P.I. Nos. 130745/1981, 157637/1984, 166943/1984, 180537/1984, 174830/1984, 195237/1984, 108249/1987, 174745/1987, 187847/1987, 97942/1988, 96159/1988 and 68746/1989.

Besides the above additives, to the heat-developable light-sensitive material may be added known photographic additives such as an antihalation dye, colloidal silver, brightening agent, hardener, antistatic agent, surfactant, inorganic or organic matting agent, antidiscoloration agent, ultraviolet absorbent and background whiteness improving agent.

These photographic additives are described in detail in RD Nos. 17029 and 29963; and JP O.P.I. NOS. 135825/1987 and 13546/1987.

These photographic additives may be added not only to the light-sensitive layer but also to any discretional component layers such as the intermediate layer, subbing layer, protective layer and backing layer.

The heat-developable color light-sensitive material of the invention preferably comprises (a) a hydrophilic binder, (b) a light-sensitive silver halide emulsion, (c) a dye-providing material, (d) an organic silver salt and (e) a reducing agent.

These constituents may be contained either all in a single photographic component layer or separately in two or more layers; for example, (a), (b), (d) and (e) are added to one layer, while (c) to a layer adjacent thereto, or else (a), (b), (c) and (d) to one layer, while (e) to another layer.

A light-sensitive layer may be comprised of two or more sublayers having substantially the same color sensitivity, in which one sublayer may have a high speed, while the other a low speed.

Where the heat-developable light-sensitive material of the invention is used as a full color recording material, it usually has three light-sensitive layers different in the color sensitivity, and the respective light-sensitive layers form or release different color dyes by heat development. In this instance, in general, a blue-sensitive layer (B) is in combination with a yellow dye (Y), a green-sensitive layer (G) with a magenta dye (M) and a red-sensitive layer (R) with a cyan dye (C), but the present invention is not restricted thereby and allows any combinations such as (B-C)-(G-M)-(R-Y), (infrared-sensitive layer-C)-(G-Y)-(R-M), and the like.

The respective layers may be arbitrarily arranged; e.g., in the order of R-G-B, G-R-B, R-G-infrared, or G-R-infrared from the support side.

The heat-developable light-sensitive material of the invention may have arbitrarily non-light-sensitive layers such as an intermediate layer, a protective layer, a filter layer, a backing layer and a peeling layer in addition to the light-sensitive layers and the hydrophobic subbing layer of the invention.

Where the heat-developable light-sensitive material is of a dye-transfer type, it has preferably an image-receiving member. The image-receiving member comprises a support and a dye-receiving layer provided thereon, but the support itself can also serve as a dye receiver.

The image-receiving layer is roughly classified into two types: one comprising a binder itself capable of receiving a dye, and the other comprising a binder containing a dye-receiving mordant.

Where the binder can receive a dye, useful as the binder is preferably a polymer material having a glass transition point of about 40° to 250° C., such as the synthetic polymer having a glass transition point of about 40° C. or more described in the 'Polymer Handbook' 2nd. ed. (J. Brandrup, E. II. Immergut) John Wiley & Sons. In general, useful polymers for this purpose have preferably a molecular weight of 2,000 to 200,000, and may be used alone or in combination, and may be copolymers comprised of two or more different repeating units.

Examples of the polymer include polyvinyl chlorides, polyesters, polycarbonates, polyvinylidene chlorides, polyethers and the like, particularly the polyvinyl chloride described in JP O.P.I. No. 223425/1984 and the polycarbonate described in JP O.P.I. No. 19138/1985 are preferred.

In the image-receiving member whose image-receiving layer's binder contains a mordant, useful as the mordant is a polymer containing a tertiary amine or quaternary amine, such as those described in U.S. Pat. No. 3,709,690 and JP O.P.I. No. 13546/1989. As the binder for keeping the mordant there may be suitably used hydrophilic binders such as gelatin and polyvinyl alcohol.

Similarly to the above image-receiving layer having the mordant in its binder, there may also be used in the invention a dye-receiving layer comprising a hydrophilic binder in which is dispersed a hydrophobic polymer latex capable of receiving a dye.

The image-receiving member of the invention may be either one comprising a support having thereon a single image-receiving layer or one having a plurality of layers coated on its support. In the latter, the layers may be all dye-receiving layers or a part alone of the layers may be an image-receiving layer.

If the image-receiving member has a separate support from the image-receiving layer, the support may be either a transparent support or a reflective support. Useful examples of the support include polyethylene terephthalate, polycarbonate, polystyrene, polyvinyl chloride, polypropylene; these supports containing white pigments such as barium sulfate, calcium carbonate, and titanium dioxide; art paper, castcoat paper, baryta paper, paper laminated with a thermoplastic resin such as polyethylene containing a white pigment, cloths, glass, and foil of a metal such as alminum. Further, a support having a pigment-containing electron beam-setting resin coated and set thereon and a reflective support having a second class diffusion reflectivity may also be used as the support for the image-receiving member of the invention.

The heat-developable light-sensitive material of the invention may be a monosheet-type heat-developable light-sensitive material having light-sensitive layers and a image-receiving layer on one and the same support as described in RD15108 and JP O.P.I. Nos. 198458/1982, 20725/1982 and 80148/1986.

To the image-receiving member of the invention may be added various known additives, including an antistaining agent, UV absorbent, brightening agent, image stabilizer, development accelerator, antifoggant, pH control agent such as an acid or acid precursos or base precursor, heat solvent, organic fluoro compound, oil, surfactant, hardener, matting agent and various metallic ions.

The heat-developable light-sensitive material of the invention may be exposed by a known exposure means suitable for the color sensitivity thereof.

Light sources for the exposure include tungsten lamp, halogen lamp, xenon lamp, mercury vapor lamp, CRT light, FO-CRT light, light-emitting diode, laser lights such as gas laser, dye laser, YAG layer and semiconductor laser, which may be used alone or in combination. A light source in combination of semiconductor laser and SHG element (second harmonic generating element) may also be used. Further, the exposure may also be made to a light emitted from a phosphor excited by electron beams, X-rays, $\gamma$-rays and $\alpha$-rays.

The exposure time depends on whether the exposure is made at one time or digitally per pixel, but is normally 0.001 to 10 seconds for the former, and to $10^{-8}$ to $10^{-2}$ second per pixel for the latter.

At the time of the exposure, the color temperature of a light source used may be adjusted, if necessary, by using a color filter, or a scanning exposure may be made with a laser light.

The heat-developable light-sensitive material of the invention, after or simultaneously with its imagewise exposure, is subjected to heat development at a temperature of preferably 70° to 200° C., more preferably 90° to 170° C., for preferably 1 second to 180 seconds, and more preferably 2 seconds to 120 seconds for the formation of a dye image. The diffusible dye's transfer to the image-receiving member may be carried out simultaneously with or after heat development in the manner of contacting the image-receiving layer surface of the image-receiving member with the light-sensitive layer side of the light-sensitive material, in which the contact of the image-receiving member with the light-sensitive material may be performed after supplying water to therebetween. Further, before the exposure, the light-sensitive material may be preheated to 70° to 160° C., or at least either one of the light-sensitive material and the image-receiving member may be heated to 80° to 120° C. immediately before the heat development as described in JP O.P.I. Nos. 143338/1985 and 162401/1986.

The heat development of the heat-developable light-sensitive material of the invention may be carried out by known heating means such as bringing the light-sensitive material into contact with a heated block, a flat heater or a heated roller or drum; passing the light-sensitive material through an atmosphere maintained at a high temperature; the use of microwave heating; or utilizing joule heat generated by energizing a heating conductive material such as carbon black provided on the back of the image-receiving member.

The heating pattern in the heat development is discretionary with no restriction; e.g., the development may be made at a consistent temperature, at a high temperature in the initial stage and at a low temperature in the latter half stage or vice versa, at three or more stepwise varied temperatures, or at continuously varied temperatures.

EXAMPLES

Example 1

(1) Preparation of light-sensitive material sample

A heat-developable light-sensitive material Sample-A (comparative sample) comprising a 100 μm-thick photographic baryta paper having thereon the following layers was prepared. The amounts of the following additives to the respective layers are shown in grams per $m^2$ of the light-sensitive material. The coating amount of silver halide emulsion is described in terms of silver.

| | |
|---|---|
| Protective layer | |
| Gelatin | 0.6 g |
| Silica powder | 0.1 g |
| Heat solvent-1 | 0.8 g |
| UV absorbent-1 | 0.2 g |
| DOP | 0.15 g |
| Zinc sulfate | 0.28 g |
| Reducing agent-1 | 0.2 g |
| Reducing agent-2 | 0.1 g |

-continued

| | |
|---|---|
| PVP | 0.11 g |
| Antifoggant-1 | 0.026 g |
| Infrared-sensitive layer | |
| Infrared-sensitive silver iodobromide emulsion Em-1 | 0.31 g |
| Reducing agent-1 | 0.3 g |
| Gelatin | 0.97 g |
| Silver benzotriazole | 0.43 g |
| Dye-providing material-1 | 1.16 g |
| PVP | 0.07 g |
| Heat solvent-1 | 1.8 g |
| DOP | 0.48 g |
| Antifoggant-1 | 0.042 g |
| Antifoggant-2 | 0.01 g |
| Antistain agent-1 | 0.22 g |
| Benzotriazole | 0.009 g |
| Antiirradiation dye-3 | 0.05 g |
| DAP-1 | 0.02 g |
| Intermediate layer | |
| Gelatin | 0.67 g |
| Heat solvent-1 | 1.01 g |
| Reducing agent-1 | 0.35 g |
| Reducing agent-2 | 0.12 g |
| UV absorbent-1 | 0.3 g |
| DOP | 0.1 g |
| Green-sensitive layer | |
| Green-sensitive silver iodobromide emulsion Em-2 | 0.21 g |
| Silver benzotriazole | 0.12 g |
| Gelatin | 0.79 g |
| Reducing agent-1 | 0.24 g |
| Dye-providing material-2 | 0.8 g |
| Antiirradiation dye-1 | 0.04 g |
| Heat solvent-1 | 1.6 g |
| PVP | 0.07 g |
| Sodium bromide | 0.0012 g |
| Benzotriazole | 0.0018 g |
| Antifoggant-1 | 0.02 g |
| Antistain agent W-1 | 0.08 g |
| DOP | 0.3 g |
| DAP-1 | 0.02 g |
| Intermediate layer | |
| Gelatin | 0.72 g |
| Heat solvent-1 | 1.28 g |
| Reducing agent-1 | 0.2 g |
| Reducing agent-2 | 0.1 g |
| UV absorbent-1 | 0.3 g |
| DOP | 0.1 g |
| Antifoggant-1 | 0.03 g |
| PVP | 0.08 g |
| Zinc sulfate | 0.19 g |
| Red-sensitive layer | |
| Red-sensitive silver iodobromide emulsion Em-3 | 0.39 g |
| Silver benzotriazole | 0.42 g |
| Gelatin | 0.86 g |
| Reducing agent-1 | 0.28 g |
| Dye-providing material-3 | 1.18 g |
| Heat solvent-1 | 2.4 g |
| PVP | 0.06 g |
| Antiirradiation dye-2 | 0.06 g |
| Sodium bromide | 0.0012 g |
| Benzotriazole | 0.0096 g |
| Antifoggant-1 | 0.039 g |
| Antistain agent-1 | 0.1 g |
| DOP | 0.3 g |
| DAP-1 | 0.03 g |

Support

Baryta paper of 100 μm in thickness.

In addition, each of the above layers was hardened with Hardener-1 in an amount of 0.03 g per gram of gelatin.

Subsequently, on a paper support was formed a subbing layer comprising a hydrophobic acryl resin Saibinol EK-112B, produced by Saiden Chemical Industry Co., and Hardener-1, and on the subbing layer was provided the same layers in the same manner as in the heat-developable light-sensitive material Sample-A except that the heat solvent excluded therefrom, whereby a heat-developable light-sensitive material Sample-B (comparative sample) was prepared.

Hardener-1

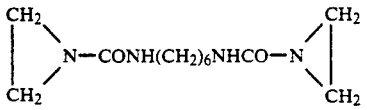

Dye-providing material-1

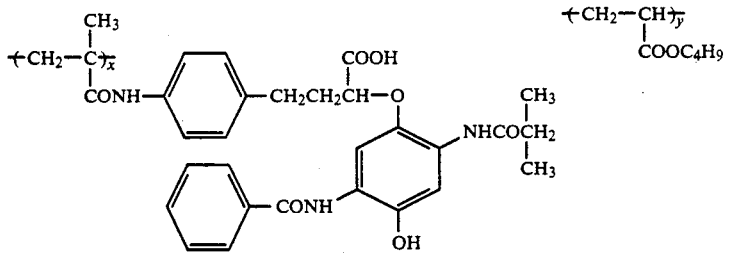

x = 60 wt %
y = 40 wt %

Dye-providing material-2

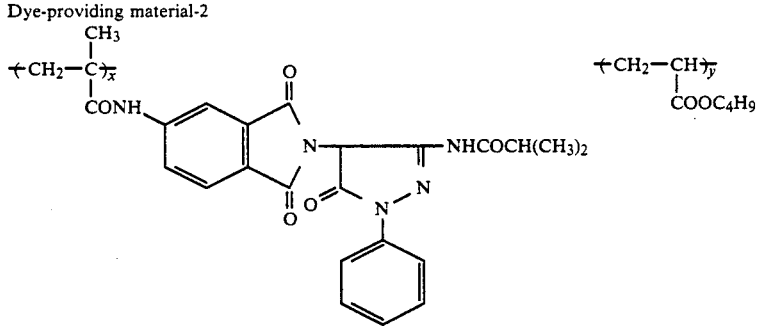

x = 50 wt %
y = 50 wt %

Dye-providing material-3

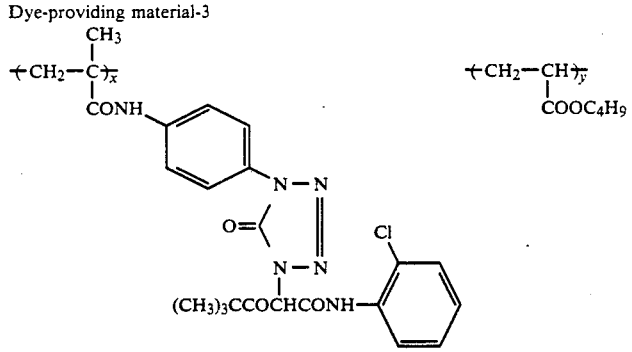

x = 70 wt %
y = 30 wt %

Heat solvent-1

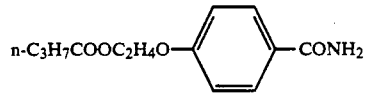

Reducing agent-1

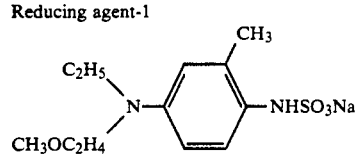

Reducing agent-2

-continued
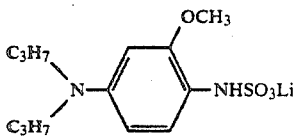
Anitfoggant-1
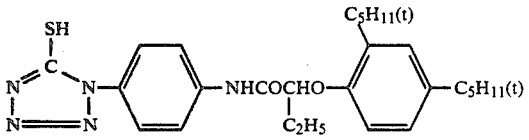
Antifoggant-2
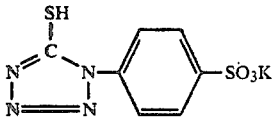
UV absorbent-1
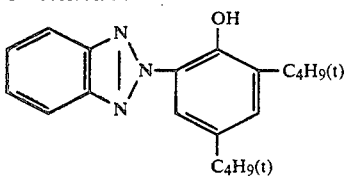
DAP-1
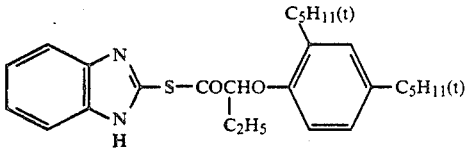
Antiirradiation dye-1
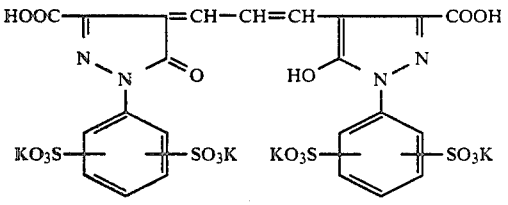
Antiirradiation dye-2
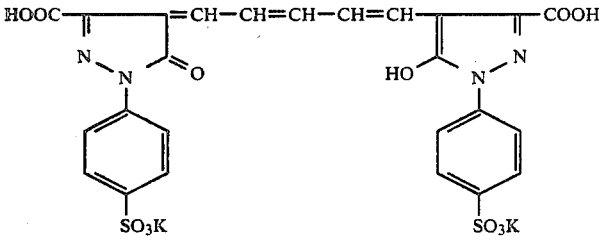
Antiiradiation dye-3
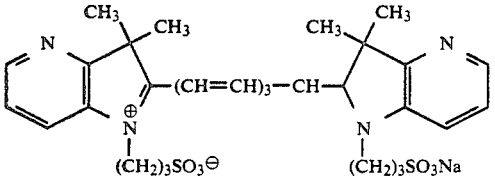
Antistain agent W-1

-continued

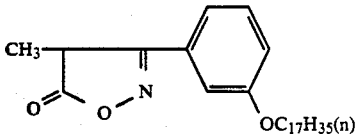

DOP
Di-(2-ethylhexyl)-phthalate

Further, the above light-sensitive layers were coated on a subbing layer comprising each of the hydrophobic resins given in the following Table 1 and Hardener-1, whereby heat-developable light-sensitive material Samples-1 to -14, and heat-developable light-sensitive material Samples-C, -D, -E, -F and -G were prepared. For coating the subbing layers of Samples-1 to -11 and A to F were used aqueous coating liquids containing the respective resins in the form of latex, while for coating the subbing layers of Samples-12 to -14 and -G were used coating liquids prepared by dissolving the respective resins in methyl-ethyl ketone. Each coating liquid was adjusted so as to have a viscosity of 4±1 centipoises and a surface tension of 30±2 dyn/cm, then coated by use of a wire bar, and then dried by being heated at 140° C. for one minute. In the above process, the used amount of each hydrophobic resin was 1 g/m$^2$, and that of Hardener-I was 0.25 g/m$^2$.

In Samples 9, 10, 11 and F, the following vinyl acetate-acrylate resin Latexes-1, -2, -3 and -4 were used, respectively.

Latex-1

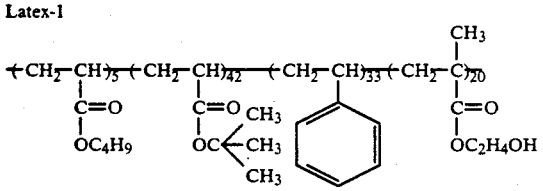

Latex-2

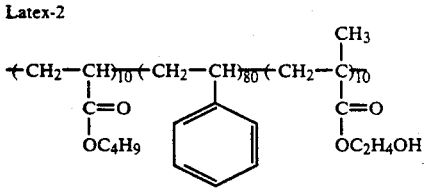

Latex-3

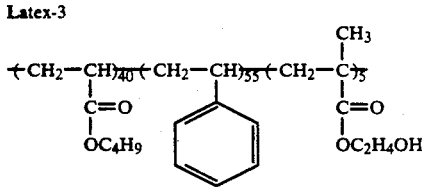

Latex-4

-continued

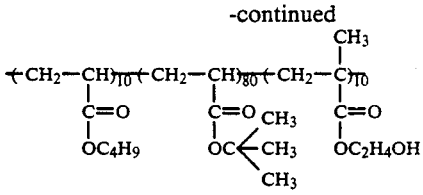

The infrared-sensitive, green-sensitive and red-sensitive emulsions used in the above heat-developable light-sensitive material samples are as follows:

Infrared-Sensitive Silver Iodobromide Emulsion

Average grain size: 015 μm ( grain size distribution: 8%), silver iodide content: 2 mol %, grain configuration: almost cubic grain with its corners and sides slightly roundish: iridium(IV)-potassium hexachloride added at the time of grain growth; optimally chemically sensitized in the presence of sodium thiosulfate, sodium chloroaurate, the following mercapto compound-1 and sensitizing dye (a).

Green-Sensitive Silver Iodobromide Emulsion

Average grain size: 0.25 μm (grain size distribution: 9%), silver iodide content: 2 mol %, grain configuration: almost cubic grain with its corners and sides slightly roundish; iridium(IV)-potassium hexachloride added at the time of grain growth; optimally chemically sensitized in the presence of sodium thiosulfate, sodium chloroaurate, the following mercapto compound-1 and sensitizing dye (b).

Red-Sensitive Silver Iodobromide Emulsion

Average grain size: 0.15 μm (grain size distribution: 8%), silver iodide content: 2 mol %, grain configuration: almost cubic grain with its corners and sides slightly roundish; iridium(IV)-potassium hexachloride added at the time of grain growth; optimally chemically sensitized in the presence of sodium thiosulfate and the following sensitizing dye (c).

In the above, the grain size distribution is defined as the value obtained by centupling (%) a value given by dividing a standard deviation of grain size by the average grain size thereof.

Upon completion of the chemical sensitization, to each of the above three light-sensitive silver halide emulsions was added 4-hydroxy-6-methyl-1,3,3a,7-tetrazaindene in an amount of 1 g per mol of silver halide.

Sensitizing dye (a)

-continued

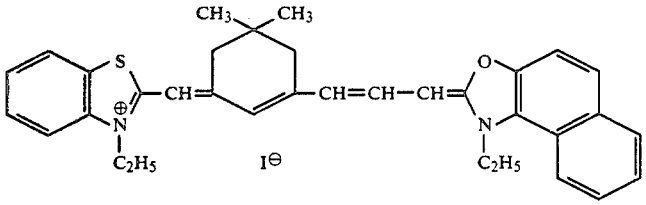

Sensitizing dye (b)

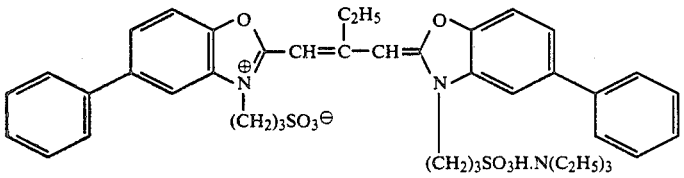

Sensitizing dye (c)

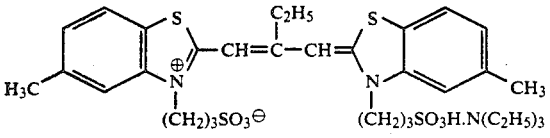

Mercapto compound-1

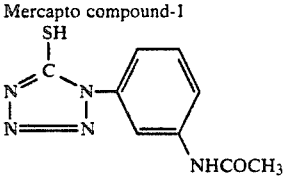

Silver Benzotriazole Emulsion

Ammoniacal silver nitrate aqueous solution and benzotriazole (containing ammonia water in 0.2 mol to benzotriazole) were added by double-ject precipitation to 10% aqueous solution of phenylcarbamoyl gelatin at 50° C. to thereby prepare an emulsion, after completion of the addition, pH was lowered, and the emulsion was subjected to aggregation and desalting treatments, whereby needle crystals (0.1 to 0.2 μm in width, 0.5 to 2 μm in length) were obtained.

(2) Preparation of dye image-receiving member

On a corona discharge-treated transparent PET support of 100 μm in thickness was coated a subbing layer consisting of a polyether resin 'Erither UE-3300,' produced by UNITIKA, Ltd., so as to have a dry thickness of 1.2 μm, and then on this was formed a dye-receiving layer having the following composition, whereby an image-receiving material Sample-1 was prepared.

| | |
|---|---|
| Polyvinyl chloride (average polymerization degree: 500) | 10 g |
| Image stabilizer-1 | 0.7 g |
| Image stabilizer-2 | 0.5 g |
| Image stabilizer-3 | 0.3 g |
| Image stabilizer-4 | 0.8 g |
| Development accelerator-1 | 0.5 g |

The coating of the above image-receiving layer was carried out by extrusion coating of a coating liquid prepared by dissolving the above constituents in methyl-ethyl ketone.

Image stabilizer-1

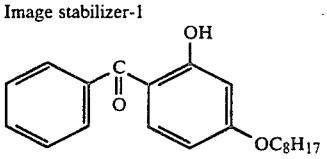

Image stabilizer-2

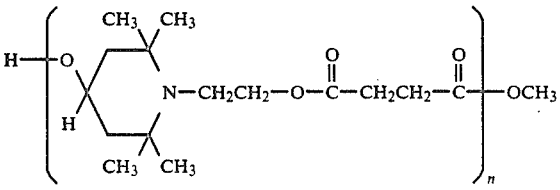

n ≈ 100

Image stabilizer-3

-continued

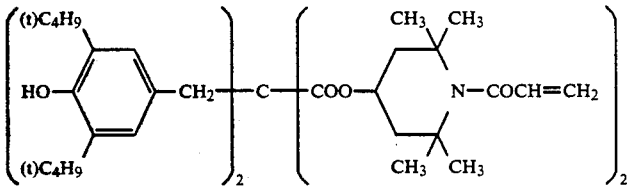

Image stabilizer-4

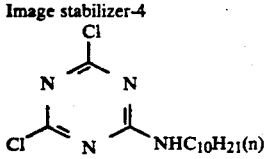

Developement accelerator-1

$(HOC_2H_4SCH_2)_2$ (3) Evaluation of the light-sensitive material

A 20 cm×20 cm-size sheet each of the heat-developable light-sensitive material Samples-1 to -8 and A to E was used to measure its curl degree at 23° C./20% RH and 23° C./80% RH.

The curl degree herein, when the light-sensitive material is placed with its light-sensitive layer side up on a horizontal flat surface, is the distance in mm from the surface up to the highest point of the rise of its curl, wherein the curl is expressed by a positive(+) value when concave, or a negative(−) value when convex.

Further, each heat-developable light-sensitive material was superposed on the dye-receiving material and heated for one minute on a flat heater at 150° C., and its curl degree upon completion of the heating was measured.

The results are shown in Table 1.

TABLE 1

| No. | Hydrophobic resin (product) | Tg (°C.) | Curl degree (mm) 23° C./20% | 23° C./80% | 150° C. |
|---|---|---|---|---|---|
| 1 | Saibinol EK-112B (Saiden Chem.) | 97 | +1 | 0 | 0 |
| 2 | Vylonal MD110 (Toyobo Co.) | 40 | +7 | −4 | +1 |
| 3 | Nipol LX303 (Nippon Zeon) | 100 | 0 | 0 | 0 |
| 4 | Nipol LX416 (Nippon Zeon) | 36 | +12 | −7 | +2 |
| 5 | Saibinol EB (Saiden Chem.) | 61 | +2 | −3 | +1 |
| 6 | Saibinol X-589-214E (Saiden Chem.) | 37 | +10 | −8 | 0 |
| 7 | Saibinol ACF-208 (Saiden Chem.) | 44 | +6 | −4 | +1 |
| 8 | Nipol LX416 (Nippon Zeon) | 36 | +14 | −9 | +1 |
| 9 | Latex-1 | 49 | +3 | −3 | +1 |
| 10 | Latex-2 | 73 | +1 | −1 | 0 |
| 11 | Latex-3 | 33 | +14 | −10 | +2 |
| 12 | Vylon 200 (Toyobo Co.) | 67 | +1 | −2 | 0 |
| 13 | Vylon 200/Bairon 300 mixture at wt ratio 4:6 (Toyobo Co.) | 32 | +11 | −9 | +1 |
| 14 | Vylon 103 (Toyobo Co.) | 47 | +4 | −3 | +2 |
| A | No subbing layer | — | +70 | −55 | +53 |
| B | No heat solvent | 97 | +1 | 0 | +63 |
| C | Saibinol X-589-104E (Saiden ch.) | −15 | +53 | −35 | +5 |
| D | Saibinol X-287-992E (Saiden ch.) | 13 | +27 | −10 | +5 |
| E | Nipol LX112 (Nippon Zeon) | 56 | +60 | −40 | +7 |
| F | Latex-4 | 22 | +25 | −8 | +4 |
| G | Vylon 500 (Toyobo Co.) | 4 | +38 | −30 | +6 |

Saibinol: Polyacryl resin
Vylonal: Polyester resin
Nipol: Polystyrene-butadiene resin
Vylon: Polyester resin As is apparent from Table 1, the heat-developable light-sensitive material samples of the invention show well-improved curl to the change in the humidity at room temperature as well as to heat, while the sample having no subbing layer shows a large curl attributable to the change in the humidity at room temperature and a high temperature. In the heat-developable light-sensitive material in which no heat solvent is present at the time of heat development and dye transfer, the heat development is not effected at all and strong curl occurs in the heat-developing process. Further, the low-Tg hydrophobic resin-containing sample shows an unstable curl characteristic to the change in the humidity at room temperature and a conspicuous curl at a high temperature.

Example 2

Heat-developable light-sensitive material Samples-15 to -17 were prepared in the same manner as in Example-1 except that the coating weight of the resin in the subbing layer of the light-sensitive material Sample-2 of Example-1 was varied as shown in Table-2, and their curl degrees at 23° C./20%RH and 23° C./80% were measured. And, each light-sensitive material was superposed on the dye-receiving material and heated for 10 seconds on a flat heater at 150° C., and its curl upon completion of the heating was measured.

The results are shown in Table 2.

TABLE 2

| No. | Amount of hydrophobic resin for subbing layer (g/m²) | Tg (°C.) | Curl degree (mm) 23° C./20% | 23° C./80% | 150° C. |
|---|---|---|---|---|---|
| 15 | 0.02 | 97 | +9 | −5 | +1 |
| 16 | 2 | 97 | 0 | −1 | 0 |
| 17 | 20 | 97 | 0 | −2 | +5 |

As is apparent from Table-2, the effect of the invention is remarkable particularly when the thickness of the subbing layer is 0.1 to 10 g/m².

Example 3

Heat-developable light-sensitive material Samples-18 to -20 were prepared in the same manner as in Example-1 except that the thickness of the paper support of the heat-developable light-sensitive material Sample-1 in Example-1 was varied as shown in Table-3, and the curl degree of each of the samples was measured in like manner, and the results are shown in Table-3.

TABLE 3

| No. | Thickness of paper support (μm) | Tg (°C.) | Curl degree (mm) 23° C./20% | 23° C./80% | 150° C. |
|---|---|---|---|---|---|
| 18 | 250 | 97 | +1 | −1 | +4 |
| 19 | 150 | 97 | 0 | −1 | 0 |
| 20 | 50 | 97 | +7 | −5 | +2 |

As is apparent from Table-3, the heat-developable light-sensitive material sample having a support of 100 μm to 200 μm in thickness shows a very small, stable curl at room temperature as well as at a high temperature; the one having a support of less than 100 μm in thickness shows a little less stable curl than the above sample; and the one having a support exceeding 200 μm in thickness shows a strong curl particularly at a high temperature.

Example 4

Heat-developable light-sensitive material Samples-21 to -23 were prepared in the same manner as in Example-1 except that the whole amount of the hydrophilic binder of the heat-developable light-sensitive material Sample-1 of Example-1 was changed as shown in Table-4, and the curl degree of each sample was evaluated. The results are shown in Table-4.

TABLE 4

| No. | Coated weight of binder (g/m²) | Tg (°C.) | Curl degree 23° C./20% | 23° C./80% | 150° C. |
|---|---|---|---|---|---|
| 21 | 10 | 97 | +9 | −5 | +2 |
| 22 | 7 | 97 | +5 | −3 | +1 |
| 23 | 4 | 97 | 0 | −1 | 0 |

From Table-4 it is apparent that where the amount of the whole hydrophilic binder in the light-sensitive layers exceeds 8 g/m², the curl stability is poor, while where the amount is not more than 8 g/m², particularly not more than 6 g/m², the curl is remarkably stable to the change in the humidity at room temperature and a high temperature.

Example 5

Heat-developable light-sensitive material Samples-24 to -27 were prepared in the same manner as in Example-1 except that the solid matter content of the hydrophobic resin subbing layer coating liquid for the heat-developable light-sensitive material Sample-10 of Example-1 was varied as shown in Table-5, and the viscosity and surface tension of the coating liquid and curl degree to the change in the humidity at room temperature and at a high temperature were measured. The coating amount of the hydrophobic resin was 5.0 g/m² in all Samples 24 to 27. The results are shown in Table 5, wherein the viscosity and surface tension of the subbing layer coating liquid are the results measured at 23° C.

TABLE 5

| No. | Solid content of subbing layer (wt %) | Viscosity of subbing layer (cp) | Surface tension of subbing layer (dyn/cm) | Curl degree 23° C./20% | 23° C./80% | 150° C. |
|---|---|---|---|---|---|---|
| 24 | 1 | 1.5 | 9.3 | +10 | −5 | +5 |
| 25 | 4 | 2.5 | 22.5 | +4 | −3 | +3 |
| 26 | 20 | 23.5 | 38.0 | 0 | 0 | +1 |
| 27 | 60 | 55 | 51.2 | +5 | −2 | +6 |

As is apparent from Table-5, when the viscosity of the coating liquid of the hydrophobic resin subbing layer is in the range according to the invention, a satisfactory curl stability to the change in the humidity at room temperature and at a high temperature can be obtained.

What is claimed is:

1. An image forming method comprising steps of
   imagewise exposing to light a heat developable light-sensitive material comprising a paper support having thereon a subbing layer comprising a hydrophobic resin having a glass transition point of from 30° C. to 250° C. and a light-sensitive layer being provided on said subbing layer, in which said light-sensitive layer comprises a hydrophilic binder, light-sensitive silver halide grains and a dye providing substance,
   developing said light-sensitive material by heating,
   contacting said light-sensitive material with a dye-receiving material, and
   transferring a diffusible dye formed in said light-sensitive material to said dye-receiving material in the presence of a solvent capable of dissolving said diffusible dye.

2. A method of claim 1, wherein said steps of developing, contacting and transferring are separately performed in the order of
   developing said light-sensitive material by heating,
   contacting said developed light-sensitive material with said dye receiving material, and
   transferring said diffusible dye formed in said developed light-sensitive material to said dye receiving material in the presence of said solvent.

3. a method of claim 1, wherein said method steps of developing, contacting and transferring are performed simultaneously by a procedure of
   contacting said exposed light-sensitive material with said dye-receiving material
   heating said light-sensitive material being contacted with said dye-receiving material in the presence of said solvent for developing the light-sensitive material and transferring said diffusible dye formed in said light-sensitive material.

4. A method of claim 1, wherein said hydrophobic resin has a glass transition point of from 40° C. to 200° C.

5. A method of claim 4, wherein said hydrophobic resin has a glass transition point of from 50° C. to 200° C.

6. A method of claim 1, wherein said subbing layer contains said hydrophobic resin in an amount of from 0.1 $g/m^2$ to 10 $g/m^2$.

7. A method of claim 1, wherein said paper support has a thickness of from 100 μm to 200 μm.

8. A method of claim 1, wherein the total amount of said hydrophilic binder contained in the layer provided on the light-sensitive layer coated side of said light-sensitive material is 1 $g/m^2$ to 8 $g/m^2$.

9. A method of claim 8, wherein the total amount of said hydrophilic binder contained in the layers provided on the light-sensitive layer coated side of said light-sensitive material is 1 $g/m^2$ to 6 $g/m^2$.

10. A method of claim 1, wherein said solvent is a solid heat solvent.

11. An image forming method comprising steps of imagewise exposing to light a heat developable light-sensitive material comprising a paper support having thereon a subbing layer comprising a hydrophobic resin and a light-sensitive layer being provided on said subbing layer and comprising a hydrophilic binder, light-sensitive silver halide grains and a dye providing substance, developing said light-sensitive material by heating, contacting said developed light-sensitive material with a dye-receiving material, and transferring a diffusible dye formed in said light-sensitive material to said dye-receiving material in the presence of a solid heat solvent capable of dissolving said diffusible dye, wherein said paper support has a thickness of from 100 μm to 200 μm, said hydrophobic resin has a glass transition within the range of from 40° C. to 200° C., the coating amount of said hydrophobic resin is 0.1 $g/m^2$ to 10 $g/m^2$ and the coating amount of said hydrophilic binder is not more than 8 $g/m^2$.

* * * * *